United States Patent [19]

Buan et al.

[11] Patent Number: 5,074,418

[45] Date of Patent: Dec. 24, 1991

[54] INK REPLENISHING SYSTEM TRANSPORT AND STORAGE CONTAINER

[75] Inventors: Danilo P. Buan, Easton; M. Anthony Melito, East Haven, both of Conn.

[73] Assignee: Pitney Bowes Inc., Stamford, Conn.

[21] Appl. No.: 582,572

[22] Filed: Sep. 12, 1990

[51] Int. Cl.[5] ..... B65D 85/00

[52] U.S. Cl. ..... 206/576; 206/471; 206/470; 206/525

[58] Field of Search ..... 206/461, 467, 470, 471, 206/525, 563, 576, 223, 320, 319

[56] References Cited

U.S. PATENT DOCUMENTS

| | | | |
|---|---|---|---|
| 3,178,019 | 4/1965 | Fetzek | 206/471 |
| 4,101,033 | 7/1978 | Schurman | 206/525 |
| 4,319,684 | 3/1982 | Backman et al. | 206/464 |
| 4,499,353 | 2/1985 | Shields | 206/470 |
| 4,687,129 | 8/1987 | Cugley | 206/44 R |
| 4,697,703 | 10/1987 | Will | 206/525 |
| 4,736,848 | 4/1988 | Lewandowski | 206/471 |
| 4,807,747 | 2/1989 | Hadtke | 206/327 |
| 4,880,989 | 11/1989 | Burnett et al. | 206/563 |
| 4,946,034 | 8/1990 | Matsubara | 206/471 |

*Primary Examiner*—David T. Fidei

*Attorney, Agent, or Firm*—Charles G. Parks, Jr.; David E. Pitchenik; Melvin J. Scolnick

[57] ABSTRACT

The transport and storage container receives an ink replenishing system characterized by housing defining a well and having a rim formed around the well opening. An ink tray is slidably supported to the forward portion of the rim. A supply and drain pump are mounted to the bottom of the housing and hoses communication the pumps and ink tray. The transport and storage container includes a housing defining a chamber open at the top, a plurality of support surfaces, and a rim formed around said chamber opening. A support rim is formed within the chamber for supporting the ink replenishing system.

2 Claims, 2 Drawing Sheets

INK REPLENISHING SYSTEM TRANSPORT AND STORAGE CONTAINER

BACKGROUND OF THE INVENTION

The present invention relates to transport containers and, more particularly, to a transport containers particularly suited for transporting a printing ink replenishing system employed in an impact printing application.

In postage meter mailing machine printing application, it is conventional to provide the mailing machine with an integral reservoir and an ink transfer system which is supplied ink from the reservoir. The ink transfer system includes an application for applying printing ink to the postage meter print indicia after each postage meter print cycle. From time to time, it is necessary for the machine operator to manually replenish the ink reservoir. It is also necessary, from time to time, for the operator to change the ink transfer pad of the replenishing system. This has been perceived as time consuming and untidy operator activity.

In an attempt to promote operator ease and sanitize the process of replenishing the ink supply and changing the ink transfer pad, a self-contain ink replenishing system has been developed. The ink replenishing system is comprised of a housing which receives a sealed ink reservoir bottle. A supply pump and a return pump are mounted to the housing, such that each pump is placed in fluid communication with the reservoir bottle upon insertion of the reservoir bottle into the housing. A supply hose and a drain hose provide fluid communication between the respective supply and drain pumps to an ink tray which houses an ink transfer pad. The housing also has a formed rim which serves to support and horizontally guide the ink tray. A suitable mailing machine has been developed which allows the housing and associated ink replenishing system components to be drop-loaded in the mailing machine.

In order to support customer delivery and storage of the ink replenishing system, a container particularly suited for the ink replenishing system has been developed.

SUMMARY OF THE INVENTION

An object of the present invention is to present an transport container particularly suitable to secure and enclose a particular ink replenishing system in such a manner that flexible components of the ink replenishing system are not caused to assume a distorted or flexed posture within the transport container. The ink replenishing system is characterized by a housing defining a well with a generally horizontal rim formed around the well opening. An ink tray is slidably supported along the upper surface of the rim which upper surface guide member for the horizontal displacement of the ink tray. Compression actuated pumps are mounted to the underside of the housing and are in communication with the ink tray through respective hoses. Each hose is secured to the housing hose fixture is limited to a defined path. The transport container provides a rim support surface for supporting the housing such that the housing is suspended within the container. A particularly formed container lid or top can then be positioned to enclose the well such that the ink transport system is secured in the housing without distortion or causing the pump or hoses to be compressed or flexed.

DETAILED DESCRIPTION OF THE PREFERRED EMBODIMENT

Figure 1:
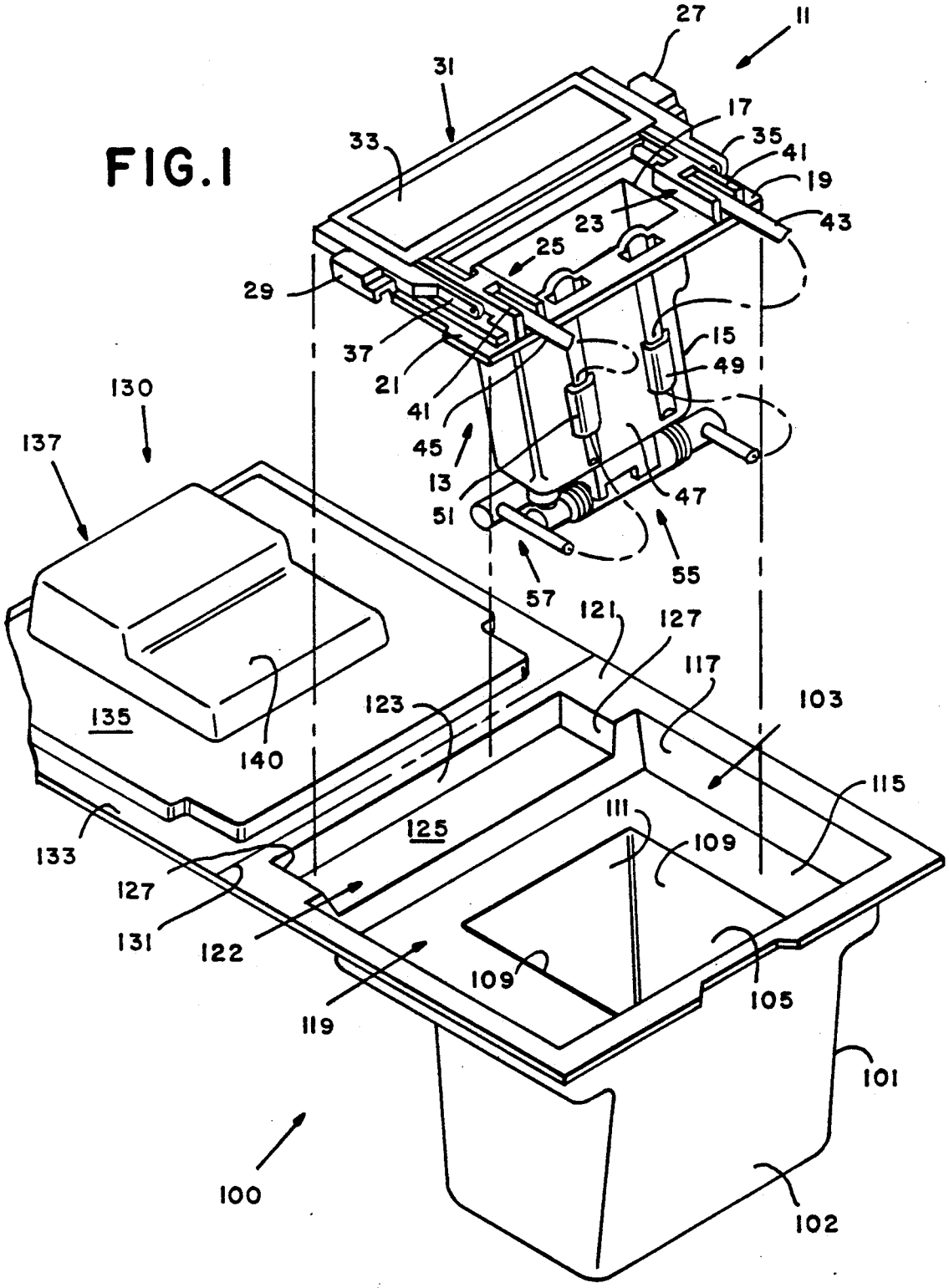
FIG. 1 is an exploded view of the container and the ink replenishing system in accordance with the present invention.
Figure 2:
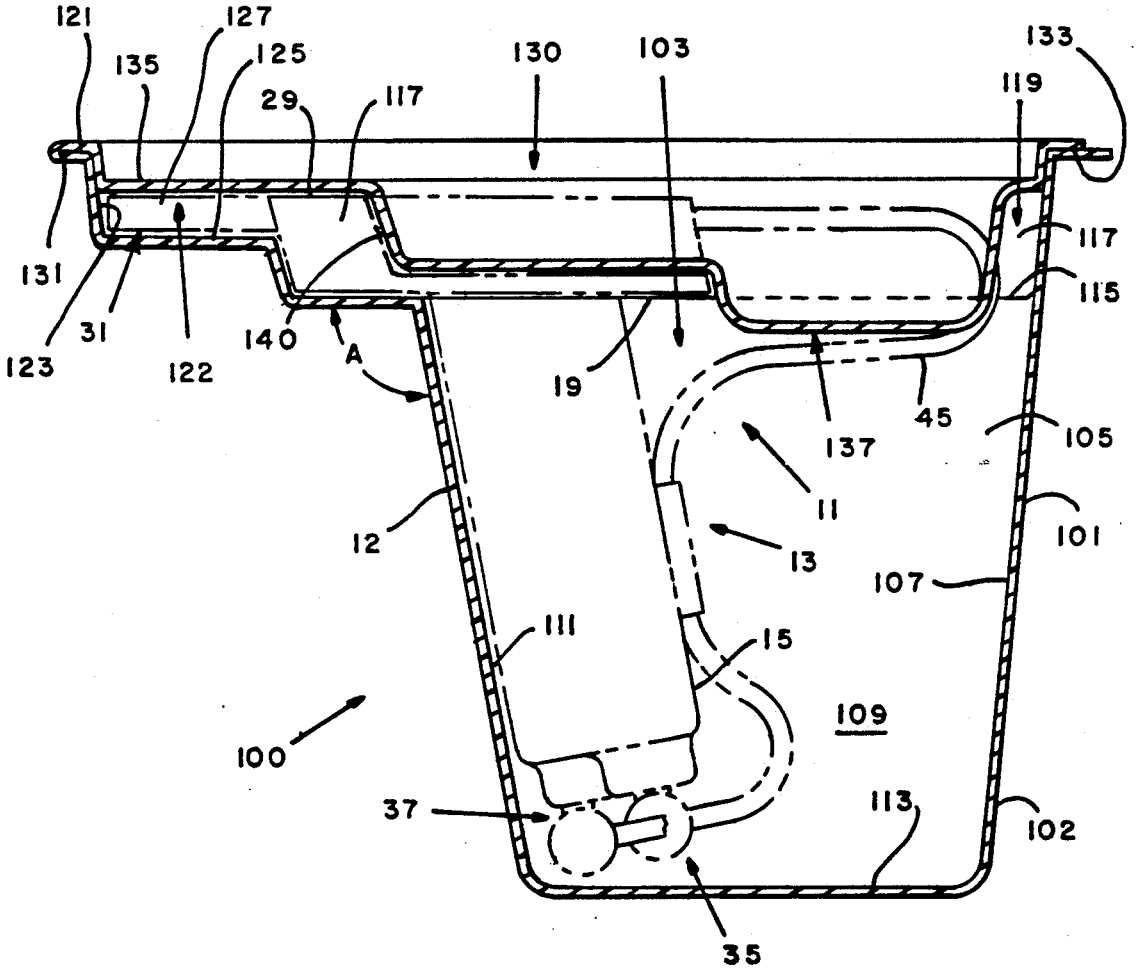
FIG. 2 is a side sectional view of the container.

Referring to FIGS. 1 and 2, an ink replenishing, generally indicated as 11, is comprised of a receptacle housing 13 configured to receive a suitably shaped ink reservoir bottle (not shown). The main section 15 of the housing 13 has a generally U-shaped configuration of uniform width. Around the housing opening or well 17 is formed a generally rectangular rim 19 of uniform thickness such that the main housing section 15 is orient with respect to the rim 19 at an angle "A" below the horizontal. Formed on the top surface 21 of the rim 19 are oppositely spaced apart guide tracks 23 and 25, respectively. Also, formed on the to surface 21 of the rim 19 and forwardly located are second guides 27 and 29, which are oppositely spaced apart and cooperative aligned linearly with respective guide tracks 23 and 25.

An ink tray 31 containing a pad 33 is supported on the forward surface 21 of the rim 19 between the guide rails 27 and 29. The ink tray 31 includes rearwardly extending arms 35 and 37. The arms 35 and 37 are positioned abutting to and outboard of respective guides 23 and 25. The forward end of the respective guides 23 and 25 are aligned to form stops to the rearward position of ink tray 31. Each guide 23 and 25 includes a channeled portion 41 through which a portion of respective flexible conduits 43 and 45, respectively, extend, one end of each conduit 43 and 45 being fixable mounted to the ink tray 31. The rearward wall 47 of the housing 15 includes respective hose restraints 49 and 51 for restraining a section of respective conduits 43 and 45 thereto. Detachably mounted to the bottom of housing 13 by any conventional means, such as, by formed clips, are pumps 55 and 57 which respectively communicate with the other end of respective hoses 43 and 45.

The transport container, generally indicated as 100, is comprised of a housing 101 having a first section 102 which defines a containment chamber 103. The containment chamber 103 is defined to have a first or lower chamber 105 defined by a rear wall 107, vertical side walls 109, a forward wall 111 and a bottom well 113. The forward wall 111 is reclined from the horizontal at an angle "A". A rim 115 is formed around the vertical opening of chamber 105 which is surrounded by a containment wall 117 which defines the second or upper chamber 119 of chamber 103. Formed around the containment wall 117 is a sealing lip 121. Formed in the forward wall 111 from a point vertically midway in the containment wall 117 is a recess 122 having a forward wall 123, bottom wall 125 and side wall 127.

The housing 100 includes a form top section 130 extending forwardly from an edge line 131 of the rim 121. The top 130 includes a matting rim 133 to rim 121 formed around vertical space section 135 which is sized and configured to be partly received vertically in and enclose the containment chamber 103. The top 130 also includes a second vertical spacer 137 configures and sized to secure the position of the ink replenishing system 11 in a manner hereafter described.

The container 100 is particularly constructed to receive the ink replenishing system 11 within the chamber 103 such that the housing rim 115 vertically supports the receptacle housing 13 along the receptacle housing rim 19. The receptacle housing 13 is supported such that the forward housing wall 12 of the main section 15 is abutting to the container wall 111 and the main section 15 is received in the container section 105. The main section 15 is thereby maintained in spaced relationship to the bottom wall 113 and rear wall 107 of chamber section 103 such that the pumps 55 and 57 and the flexible conduits 43 and 45 are spaced from the chamber walls 107, 109 and 111. The ink tray 31 is received in the recess 122 and is vertically supported by the forward wall 123. Lateral movement of the replenishing system is restricted by the containment walls 117, 123 and 127.

Following the placement of the ink replenishing system 11 in the container 100, the top 130 may be pivotally folded along line 131 to enclose the chamber 103 such that the spacer 137 is tailor fitted between the chamber wall 107 and the rear portion of rim 19. The spacer 137 includes a portion 140 which is vertically abutting housing rim 19 between the guide tracks 23 and 25 and horizontally abuts a rear portion to the ink tray 31. The flexible conduits 43 and 45 are located to respective sides of the spacer 137. The spacer 135 is provided to vertically secure the housing rim 19 against the support rim 115.

It should now be appreciated that the ink replenishing system is secured in the transport container 100 in a manner which isolate the pumps 55 and 57, and the flexible conduits 43 and 45.

What is claimed is:

1. In combination a transport and storage container for an ink replenishing system and a ink replenishing system, comprising a vertically elongated housing having a generally uniform thickness, a rim formed around the top portion of the housing extending outwardly therefrom, said rim extending generally horizontally and said housing being angled rearwardly with said rim, an ink tray slidably supported on said forward portion of said rim, said rim having guide means for horizontally guiding said ink tray, a pump fixably mounted to the bottom of said housing and conduit means for providing communication between said pumps and said tray, said transport and storage container comprising a container housing having interior walls defining a vertical chamber open at the top, a plurality of support surfaces, and having a rim formed around said chamber opening, said chamber being comprised of vertically aligned first and second chamber sections, said container housing to have a support rim formed between said first and second sections, said housing further having a recess formed in said forward chamber wall such that said ink system is supported on said rim.

2. A transport and storage container as claimed in claim 1 further comprising an enclosing means for enclosing said chamber opening and compressing said rim of said ink replenishing system against said support rim.

* * * * *